US006978568B2

(12) United States Patent
Jewell

(10) Patent No.: US 6,978,568 B2
(45) Date of Patent: Dec. 27, 2005

(54) TRIGGER MECHANISM FOR FIREARMS

(76) Inventor: Arnold W. Jewell, 1490 White Water Rd., New Braunfels, TX (US) 78132

( * ) Notice: Subject to any disclaimer, the term of this patent is extended or adjusted under 35 U.S.C. 154(b) by 0 days.

(21) Appl. No.: 10/790,659

(22) Filed: Mar. 1, 2004

(65) Prior Publication Data

US 2005/0188580 A1 Sep. 1, 2005

(51) Int. Cl.[7] ..... F41A 19/12; F41A 19/15; F41A 19/16

(52) U.S. Cl. ..... 42/69.02; 89/27.11

(58) Field of Search ..... 42/69.01, 69.02; 89/27.11

(56) References Cited

U.S. PATENT DOCUMENTS 2,126,076 A * 8/1938 Wright et al. ..... 42/69.02

4,058,924 A * 11/1977 Mullner ..... 42/69.01

FOREIGN PATENT DOCUMENTS

DE 39 06 212 A1 * 9/1989

* cited by examiner

*Primary Examiner*—Stephen M. Johnson

(57) ABSTRACT

A firing mechanism for a firearm having a spring pressed firing pin comprises a sear engagable with the spring pressed firing pin in its cocked position and releasable by the sequential release of a cocking lever and a sear release lever through an abutting contact of a portion of the trigger element with the sear release lever. The initial and final positions of the trigger, as well as the spring bias imparted to the trigger, are readily adjustable, without disassembly. All adjustments of the trigger positions, and the spring force on the trigger, are readily adjustable by screws which are accessible through the between of two horizontally spaced trigger housing plates.

3 Claims, 1 Drawing Sheet

TRIGGER MECHANISM FOR FIREARMS

BACKGROUND OF THE INVENTION

1. Field of the Invention

The present invention relates to an improved trigger mechanism for firearms, particularly bolt action rifles, which will allow for convenient access to parts and adjustments permitting extreme ranges of pull weights (sub-ounce to several pounds) and trigger travel (short or long) without the necessity of removing the receiver from the stock or the trigger from the receiver.

2. Prior Art

Most triggers now in use are designed for limited to narrow ranges of trigger pull weights and travel. Design geometry requires removal of the receiver from the stock or the trigger from the receiver to effect significant changes in either weight or pull or trigger travel.

Some triggers that may be changed from one range of adjustability to another require removal from the receiver and disassembly of the trigger mechanism for access to the parts necessary to effect said changes.

Every user of a firearm, such as a rifle, for highly accurate target or hunting purposes has a preferred trigger pull. Substantially all known trigger mechanisms have a spring bias imparted to the trigger to resist the pulling movement of the operator. The adjustment of the compression or tension forces in the spring opposing the movement of the trigger will provide an adjustment in resisting force of the trigger to the pulling action. Thus, a trigger mechanism should be capable of a variety of adjustments without removal of the entire mechanism from the stock of the firearm, or the trigger mechanism from the receiver.

What is needed is an economically manufacturable trigger mechanism which can be secured to the receiver of firearms and permit the custom adjustment of the pulling characteristics of the trigger mechanism without removal of the trigger mechanism from the receiver or the receiver from the stock.

It is accordingly an object of this invention to provide such improved trigger mechanism.

SUMMARY OF THE INVENTION

A trigger mechanism embodying this invention is housed or mounted within two parallel plates which, in turn, are readily insertable into the opening customarily provided in the stock and receiver of the firearm for receipt of the trigger mechanism. The trigger housing plates are secured in spaced parallel relationship by a plurality of horizontal spacers. The top ends of the plates are conventionally secured to the bottom of the receiver of the firearm. The trigger housing plates are thus disposed immediately below the path of movement of the breech bolt containing the firing pin which, when cocked, is spring-loaded to move forwardly to engage the primer of a cartridge in the breech of the gun. A cocking lever is pivotally mounted in the upper portions of the two laterally spaced plates and has a cocking projection movable into the path of movement of the spring-pressed firing pin so that a tab on the firing pin engages a cocking surface on the cocking lever to retain the firing pin in its cocked position. The cocking lever is spring-biased into engagement with the firing pin tab.

In such engaged position, the spring-pressed firing pin exerts a force on the cocking lever, tending to rotate it in a counterclockwise direction out of the path of the firing pin. Such counterclockwise movement of the cocking lever is prevented by a sear release lever which is medially pivotally mounted between the two plate elements and is biased by the spring operating on the sear into engagement with the cocking lever to prevent counterclockwise rotation of the cocking lever to release the firing pin. Clockwise movement of the sear release lever will release the cocking lever to move out of engagement with the firing pin.

The sear release lever, in turn, is held in its sear locking position by a spring.

The trigger has its medial portion pivotally mounted on a transverse pin located adjacent the bottom edges of the two plates. The upper trigger portion has only an abutting contact with the bottom end of the sear release lever. Such abutting contact is provided by a projection on the sear release lever which projects horizontally toward the upper portion of the trigger element. A spring maintains the abutting contact between the projection and the trigger element.

Thus, the application of a pulling force to the depending finger portion of the trigger will produce a clockwise movement of the sear release lever, which, in turn, will release the cocking lever for counterclockwise movement to permit the cocking lever to be cammed out of engagement with the spring-pressed firing pin and effect the firing of the gun.

With the mechanism thus far described, the pull resistance of the trigger is opposed by a separate trigger spring which operates between a rearward projection on the trigger element and an integral spacer of trigger housing plates. The spring is disposed in a vertical hole in the rearward trigger projection, and the top end of the spring abuts the spacer. An adjustable screw is inserted in the bottom of such hole to provide a convenient means for adjusting the amount of spring force exerted on the trigger as it is pulled. A stop screw is threaded through the rearward trigger projection to provide an adjustable position stop for the trigger at a position just beyond its firing position.

To determine the initial position of the trigger, a screw is threaded through a horizontal hole in the trigger projection and engages a transverse hole in the trigger housing plates.

If a safety mechanism is required, this may be conveniently added to the aforedescribed trigger mechanism. All that is required is a slide or cam that will prevent clockwise movement of the sear release lever when the safety mechanism is in the "safe" position. Manual movement of the safety mechanism to its "firing" position will permit clockwise movement of the sear release lever by pulling of the trigger.

From the foregoing description, it will be readily apparent to those skilled in the art that a trigger mechanism embodying this invention provides a multiplicity of desirable adjustments which can be made without removing the trigger mechanism from the receiver or the receiver from the stock. All such adjustments are accomplished by screws which are accessible through the spaced bottom portions of the trigger housing plates.

Further advantages of the invention will be readily apparent to those skilled in the art by the following detailed description, taken in conjunction with the annexed drawings on which is shown a preferred embodiment of the invention.

LEGEND

Figure 1:
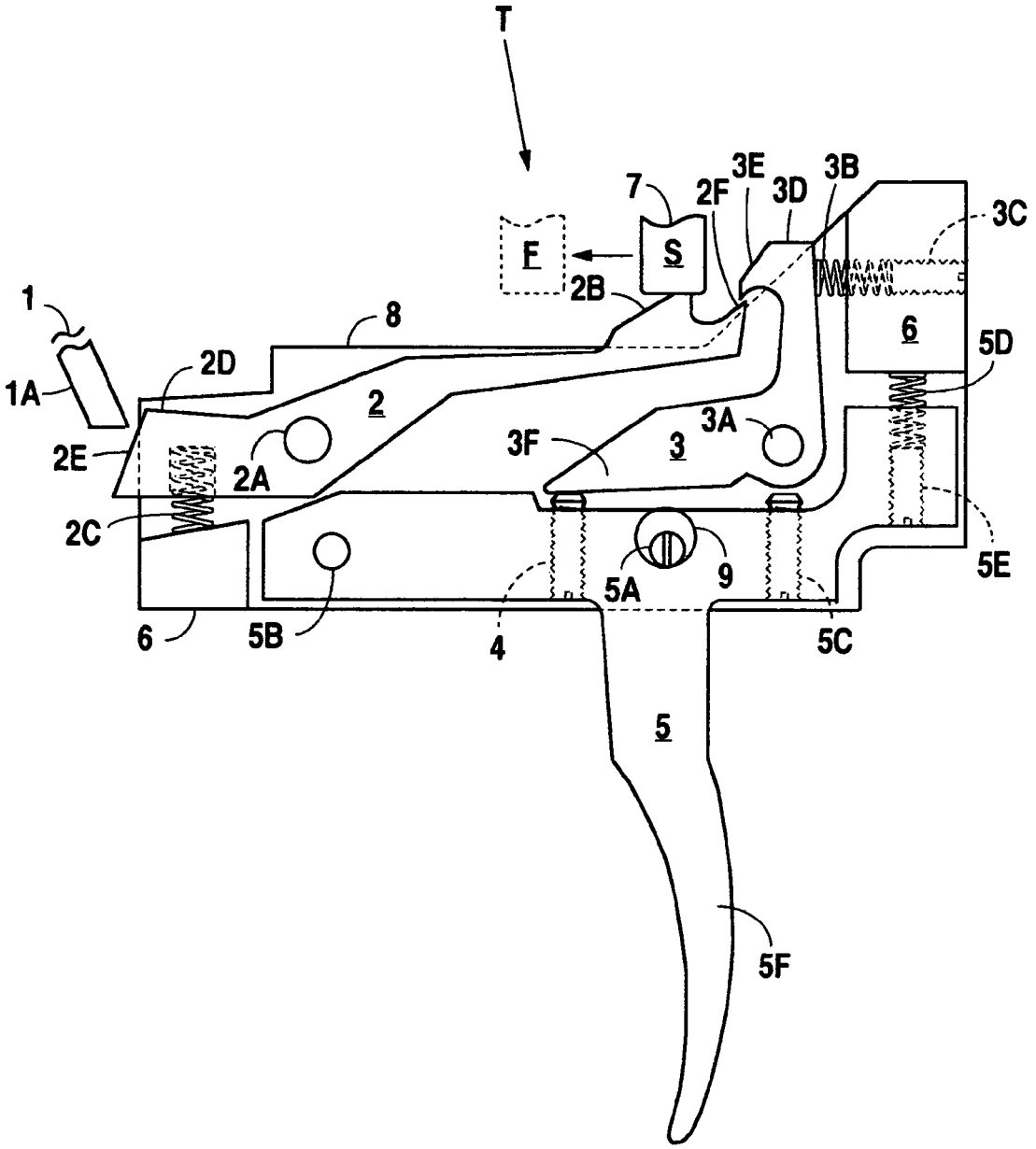
FIG. 1 is a vertical elevational view of the trigger mechanism embodying this invention with one of the side plates of the trigger mechanism removed for clarity of illustration.

1 Firing Pin Release Lever
2 Cocking Lever
2A Cocking Lever Pivot Pin
2B Safety Engagement Ramp
2C Cocking Lever Return Spring
3 Sear Release Lever
3A Sear Release Lever Pivot Pin
3B Sear Release Lever Return Spring
3C Sear Release Lever Spring Adjustment Screw
4 Sear Engagement Adjustment Screw
5 Trigger
5A Trigger Travel Limit Screw
5B Trigger Pivot Pin
5C Trigger Overtravel Adjustment Screw
5D Weight of Pull Spring
5E Weight of Pull Adjustment Screw
6 Integral Spacer
7 Safety "Post"
8 Trigger Housing Plate
9 Trigger Position Limit Hole(s)

DETAILED DESCRIPTION OF PREFERRED EMBODIMENT

The trigger mechanism of this invention, while not limited thereto, is designed for use in a bolt action rifle. Such rifle conventionally has a receiver secured to a barrel, and the receiver mounts a manually reciprocated bolt which contains a spring-pressed firing pin. The receiver and barrel are conventionally supported in a stock. All of these elements are well known in the art, and a detailed description or illustration is deemed unnecessary.

Referring to the drawings (FIG. 1), spring-pressed firing pin (1), which is normally mounted in the manually actuated bolt (not shown), is schematically illustrated by reference numeral 1. Beneath spring-pressed firing pin (1), a trigger mechanism T is mounted in conventional fashion to the receiver (not shown) of the gun in which the bolt and firing pin are mounted. Trigger mechanism T comprises a pair of plates (8) which are disposed and spaced in parallel relationship by a plurality of integral spacers (6) which are preferably mounted in horizontal alignment and adjacent the lower and upper portions of trigger plates (8).

Cocking lever (2) is mounted on horizontal pivot pin (2A). Pivot pin (2A) is secured between trigger plates (8) in any conventional fashion. Preferably, such securement is detachable.

Cocking lever (2) has an upwardly projection portion (2D) having a vertical rearward facing planar surface (2E), disposed in the path of movement of depending tab (1A) on spring-pressed firing pin (1). Firing pin (1) is thus secured in a cocked position by vertical planar surface (2E) and imposes a counterclockwise force on cocking lever (2), tending to urge it out of engagement with firing pin tab (1A).

To prevent such counterclockwise movement of cocking lever (2), sear release lever (3) is pivotally mounted between plates (8) on another pivot pin (3A). Sear release lever (3) has a forward, horizontal projection (3D) having a top horizontal surface (3E) which engages a horizontal, upward-projecting surface (2F) provided on the top of cocking lever (2).

Thus, so long as sear release lever (3) is locked against the clockwise movement about first pivot pin (3A), cocking lever (2) cannot rotate counterclockwise about pin (2A) to release spring-pressed firing pin (1).

Sear release lever (3) is held in its cocked position by adjustable spring (3B). Clockwise rotation of sear release lever (3) will release cocking lever projection (2F), permitting such lever to rotate in a counterclockwise direction by the counterclockwise forces imparted to it by firing pin tab (1A), and release firing pin (1).

The bottom end (3F) of sear release lever (3) is abuttingly engaged by sear adjustment screw (4) threaded vertically in a forward projection of trigger element (5).

Trigger element (5) is pivotally mounted between trigger housing plates (8) on pivot pin (5B). Trigger (5) has a depending finger engagable element (5F) which protrudes downwardly out of trigger housing plates (8). A pulling movement on finger element (5F) will produce a vertical shifting of sear engagement screw (4) which is threaded vertically into the forward projection of trigger (5), thus causing forward projection (3F) of sear release lever (3) to rotate clockwise. Thus, cocking lever (2) may be released from sear release lever (3), and cocking lever (2) from firing pin (1), to fire the gun.

To return trigger mechanism T to its cocked position relative to firing pin (1), compression spring (2C) is vertically retained in a recess in the forward projection of cocking lever (2) and is compressible against forward integral spacer (6) of trigger housing plate (8), thus imparting a simultaneous bias of cocking lever (2) and sear release lever (3) to return these elements to their cocked positions so as to engage firing pin tab (1A) when the bolt (not shown) is reciprocated to the cocked position. Compression spring (2C) effects return of cocking lever (2) to its engaged position with projection (2F) of sear release lever projection (3E).

Spring (5D) is provided to oppose pulling movement of trigger (5) and to return it to its normal inactive position upon release of finger portion (5F) of trigger (5).

The most rearward portion of trigger (5) is provided with a vertical threaded hole within which screw (5E) and spring (5D) are mounted. Accessible through the bottom of horizontally spaced trigger housing plates (8), spring (5D) is adjustably compressed between weight of pull adjustment screw (5E) and top integral spacer (6).

Adjustment screw (5C) is mounted likewise in a second hole and, when trigger is pulled, determines the maximum limit of trigger pull distance by engaging the bottom of sear release lever (3) in line with its pivot pin (3A). Obviously, this adjustment should permit the trigger to be pulled beyond the firing position.

Initial position of trigger (5), as well as its total travel limits, is determined by screw (5A) threaded horizontally through the upper portion of trigger (5) and extending to the outside surfaces of trigger housing plates (8) through oversized holes (9), adequate to allow needed travel.

The safety mechanism may be comprised of a fitted "post" (7) into the bottom of the slide safety lever of the receiver (not shown) and a cam-faced safety engagement ramp (2B) which is an integral part of cocking lever (2). Moving the slide safety lever rearward to the "safe" position allows the safety "post" (7) to engage the angle of safety engagement ramp (2B), forcing cocking lever (2) downward, disengaging it from sear release lever (3) and locking it in place relative to firing pin release lever (1).

In FIG. 1, by example, safety "post" (7) is shown in the "safe" position (S). It is shown in phantom in the "fire" position (F).

Those skilled in the art will recognize that this invention is unique in that it permits a wide range of adjustments without disassembly of the gun through readily accessible components.

I claim:

1. A trigger mechanism for cocking and releasing a spring-pressed firing pin of a firearm, comprising, in combination:

a trigger housing comprising two horizontally spaced vertical plate elements mountable below said firing pin;

a cocking level pivotally mounted between upper portions of said plate elements and releasably engagable with the firing pin in a first pivotal position to secure the firing pin in its cocked position, and disengagable from the firing pin in a second pivotal position;

a sear release lever pivotally mounted between said plate elements and engagable with said cocking lever in one pivotal position to hold said sear in its said first position, and pivotally movable to a second pivotal position permitting movement of said cocking lever to its said second pivotal position;

a trigger element medially pivotally mounted between said plate elements below said levers and movable between an initial unpulled position to a pulled firing position, said trigger element having forwardly and rearwardly projecting medial portions;

said trigger element having a finger engageable element projecting downwardly out of said trigger housing;

means for engaging said sear release lever responsive to a pulling movement on said finger engageable element, whereby pulling movement on said finger engageable element effects movement of said sear release lever to its said second position, permitting movement of said sear release lever and said cocking lever concurrently to their respective second positions to release the spring-pressed firing pin to fire the firearm;

a first resilient means to return said sear release lever to its said first position upon release of said finger piece of said trigger element;

a second resilient means operable to return said cocking lever and said sear release lever to their first positions when the firing pin is retracted to its cocked position;

a third resilient means operable to return said trigger elements to a first position;

a plurality of spacer elements securing said vertical plate elements in said horizontally spaced relation, a first vertically adjustable screw in said rearward projecting portion of said trigger element to adjust forces requirement to pull said trigger element from an initial, unfired position;

a second vertically adjustable screw in said rearwardly projecting portion of said trigger element to determine the limiting pulled position of said trigger element;

a third vertically adjustable screw in said forward projecting portion of said trigger element to determine said first position of said sear release lever;

a fourth horizontally adjustable screw in said integral spacer to capture said first resilient means to return said sear release lever to its first position.

2. The trigger mechanism of claim 1 further comprising means for limiting a pull distance of said trigger element.

3. The trigger of claim 2 wherein said limiting means is accessible through said plate elements.

* * * * *